US008584471B2

(12) United States Patent
Schwartz et al.

(10) Patent No.: US 8,584,471 B2
(45) Date of Patent: Nov. 19, 2013

(54) THERMOACOUSTIC APPARATUS WITH SERIES-CONNECTED STAGES

(75) Inventors: David Eric Schwartz, Menlo Park, CA (US); Sean Garner, San Francisco, CA (US)

(73) Assignee: Palo Alto Research, Palo Alto, CA (US)

( * ) Notice: Subject to any disclaimer, the term of this patent is extended or adjusted under 35 U.S.C. 154(b) by 873 days.

(21) Appl. No.: 12/771,617

(22) Filed: Apr. 30, 2010

(65) Prior Publication Data

US 2011/0265493 A1 Nov. 3, 2011

(51) Int. Cl.
*F25B 9/00* (2006.01)

(52) U.S. Cl.
USPC ..... 62/6; 62/79; 62/467

(58) Field of Classification Search
USPC ..... 62/6, 79, 114, 118, 467; 165/104.34, 165/117; 60/520, 522, 526
See application file for complete search history.

(56) References Cited

U.S. PATENT DOCUMENTS

| | | | | |
|---|---|---|---|---|
| 3,548,589 | A | 12/1970 | Cooke et al. | |
| 4,114,380 | A | 9/1978 | Ceperley | |
| 4,355,517 | A | 10/1982 | Ceperley | |
| 4,389,849 | A | 6/1983 | Gasser et al. | |
| 4,398,398 | A | 8/1983 | Wheatley et al. | |
| 4,489,553 | A | 12/1984 | Wheatley et al. | |
| 4,534,176 | A | 8/1985 | Horn et al. | |
| 5,167,124 | A | 12/1992 | Lucas | |
| 5,303,555 | A | 4/1994 | Chrysler et al. | |
| 5,329,768 | A | 7/1994 | Moscrip | |
| 5,357,757 | A | 10/1994 | Lucas | |
| 5,369,625 | A | 11/1994 | Gabrielson | |
| 5,647,216 | A | 7/1997 | Garrett | |
| 5,673,561 | A | 10/1997 | Moss | |
| 5,857,340 | A * | 1/1999 | Garrett | 62/6 |
| 6,032,464 | A * | 3/2000 | Swift et al. | 60/520 |
| 6,233,946 | B1 * | 5/2001 | Masuda | 62/6 |
| 6,314,740 | B1 | 11/2001 | De Blok et al. | |
| 6,385,972 | B1 | 5/2002 | Fellows | |
| 6,560,970 | B1 | 5/2003 | Swift | |
| 6,571,552 | B2 | 6/2003 | Ban et al. | |

(Continued)

FOREIGN PATENT DOCUMENTS

| | | | |
|---|---|---|---|
| WO | 2005/001269 | A1 | 1/2005 |
| WO | 2010/107308 | A1 | 9/2010 |

OTHER PUBLICATIONS de Blok, K., "4-stage thermo acoustic power generator", Aster Thermoakoestische Systemen, FACT Foundation,Jul. 12, 2010.

(Continued)

*Primary Examiner* — Mohammad M Ali
(74) *Attorney, Agent, or Firm* — Jonathan A. Small

(57) ABSTRACT

A thermoacoustic apparatus includes multiple thermoacoustic device stages, such as individual thermoacoustic refrigerators, connected in a looped series such that excess acoustic energy from a first stage forms a part of the input energy to the next successive stage. Each stage includes an acoustic source, a regenerator, and a plurality of heat exchangers. The stages are interconnected by transmission lines. The dimensions of the transmission lines, materials used, and the operating parameters are selected so that that excess acoustic power is communicated to a succeeding stage with a pressure phase at the back of an acoustic source of the succeeding stage such that the electric power required by the acoustic source of the succeeding stage is minimized for a given acoustic power produced by the second stage. Improved operating efficiency of the thermoacoustic apparatus is thereby provided.

20 Claims, 8 Drawing Sheets

(56) References Cited

U.S. PATENT DOCUMENTS

| | | | | |
|---|---|---|---|---|
| 6,574,968 | B1 * | 6/2003 | Symko et al. | 62/6 |
| 6,578,364 | B2 | 6/2003 | Corey | |
| 6,591,610 | B2 | 7/2003 | Yazawa et al. | |
| 6,604,364 | B1 | 8/2003 | Arman et al. | |
| 6,644,028 | B1 | 11/2003 | Swift et al. | |
| 6,658,862 | B2 | 12/2003 | Swift et al. | |
| 6,688,112 | B2 | 2/2004 | Raspet et al. | |
| 6,701,708 | B2 * | 3/2004 | Gross et al. | 60/517 |
| 6,711,905 | B2 | 3/2004 | Howard | |
| 6,725,670 | B2 | 4/2004 | Smith et al. | |
| 6,732,515 | B1 | 5/2004 | Weiland et al. | |
| 6,792,764 | B2 | 9/2004 | Poese et al. | |
| 6,804,967 | B2 | 10/2004 | Symko et al. | |
| 6,868,673 | B2 | 3/2005 | Weiland et al. | |
| 6,910,332 | B2 | 6/2005 | Fellows | |
| 6,983,610 | B1 * | 1/2006 | Olson | 62/6 |
| 7,017,351 | B2 | 3/2006 | Hao et al. | |
| 7,055,332 | B2 | 6/2006 | Poese et al. | |
| 7,062,921 | B2 | 6/2006 | Jeng et al. | |
| 7,081,699 | B2 | 7/2006 | Keolian et al. | |
| 7,143,586 | B2 | 12/2006 | Smith et al. | |
| 7,156,487 | B2 | 1/2007 | Chou et al. | |
| 7,240,495 | B2 | 7/2007 | Symko et al. | |
| 7,263,837 | B2 | 9/2007 | Smith | |
| 7,290,771 | B2 | 11/2007 | Smith | |
| 7,404,296 | B2 * | 7/2008 | Watanabe et al. | 62/6 |
| 7,434,409 | B2 | 10/2008 | Gedeon | |
| 7,603,866 | B2 * | 10/2009 | Watanabe et al. | 62/6 |
| 7,804,046 | B2 * | 9/2010 | Watanabe et al. | 219/482 |
| 7,908,856 | B2 | 3/2011 | Backhaus et al. | |
| 2003/0226364 | A1 | 12/2003 | Swift et al. | |
| 2006/0266041 | A1 | 11/2006 | Fellows | |
| 2006/0266052 | A1 | 11/2006 | Hsing et al. | |
| 2007/0261839 | A1 | 11/2007 | Watanabe et al. | |
| 2008/0060364 | A1 | 3/2008 | Watanabe et al. | |

OTHER PUBLICATIONS

Radebaugh, R., "Development of the Pulse Tube Refrigerator as an Efficient and Reliable Cryocooler", Proc. Inst. of Refrigeration (London 1999-2000).

Rossing, T. D. (Ed.), "Springer Handbook of Acoustics", Ch. 7, pp. 239-255 (Springer 2007).

Physorg.com, "A sound way to turn heat into electricity", 3 pages (Jun. 4, 2007).

Swift, G.W., et al., "Acoustic recovery of lost power in pulse tube refrigerators", J. Accoust. Soc. Am. (2), pt. 1, pp. 711-724 (Feb. 1999).

Spoelstra, S. et al., "ThermoAcoustic Technology for Energy Applications", Interim Activity Report, FP7-Energy-2008-FET, European Commission within the Seventh Framework Programme (2007-2013), Feb. 10, 2010.

* cited by examiner

THERMOACOUSTIC APPARATUS WITH SERIES-CONNECTED STAGES

BACKGROUND

The present disclosure is related to thermoacoustic devices, and more specifically to a multiple-stage thermoacoustic device in which the stages are connected in series to provide improved power recovery and device efficiency.

The pulse-tube refrigerator, an example of which is shown in FIG. 1, typifies travelling-wave thermoacoustic refrigerators. In device 10, an acoustic wave travels through a gas. The pressure and velocity oscillations of the gas are largely in-phase in certain regions of the device. Thus, these devices are generally referred to as traveling-wave devices. See, for example, U.S. patent application Ser. No. 12/533,839 and U.S. patent application Ser. No. 12/533,874, each of which being incorporated herein by reference.

In device 10, an acoustic source 12, generally an electromechanical transducer such as a moving piston, generates oscillating acoustic energy in a sealed enclosure 14 containing compressed gas. Combinations of noble gases, notably helium, are often used, though many gases, including air, can be utilized. The acoustic energy passes through a first heat exchanger, the "hot" heat exchanger 16, generally connected, for example via heat exchange fluid, to a heat reservoir at ambient temperature, a regenerative heat exchanger, or "regenerator" 18 (described below), and another heat exchanger, the "cold" heat exchanger 20, which is connected, for example via heat exchange fluid, to the thermal load which is to be cooled by the refrigerator. Usually, the cold heat exchanger is followed by another tube, called a "pulse tube," 22 and a last ambient-temperature heat exchanger, the "ambient" heat exchanger 24, which serves to isolate the cold heat exchanger and thereby reduce parasitic heat loading of the refrigerator. The "hot" heat exchanger 16 and "ambient" heat exchanger 24 are often a the same temperature. After the "ambient" heat exchanger is an acoustic load 26, often an orifice in combination with inertances and compliances, which dissipates acoustic energy. Here, a "heat exchanger" is taken to mean a device which exchanges heat between a gas inside the thermoacoustic device and an outside fluid, such as a stream of air.

In steady state, a temperature gradient is established in the regenerator in the direction from the hot to the cold heat exchanger. Heat is ideally transferred nearly isothermally between the gas and the regenerator material, often metal or ceramic porous material or mesh. With traveling-wave acoustic phasing, the gas in the regenerator undergoes an approximate Stirling cycle. In this way, the maximum heat can be moved from the cold to the hot heat exchanger per acoustic energy consumed.

Oscillating acoustic power is described by an oscillating pressure, P, in combination with an oscillating volume velocity, U, which is linear velocity, v, times the cross-sectional area of the enclosure. These quantities can be generally represented as complex phasors, $P(t)=pe^{j\phi_P}e^{j\omega t}$ and $U(t)=ue^{-j\phi_u}e^{j\omega t}$, with j representing the square root of −1, p and u representing peak magnitude of the pressure and volume velocity, respectively, ω representing the radial frequency of oscillation, and $\phi_p$ and $\phi_u$ representing constant phase offsets of the pressure and volume velocity components, respectively. The pressure is given by $P_m+\mathrm{Re}[P(t)]$, where $P_m$ is the mean pressure. Likewise, the (signed) volume velocity is given by Re[U(t)]. The acoustic power is said to have travelling-wave phasing if P(t) and U(t) are in-phase, that is $\phi_P-\phi_U=0$. With travelling-wave phasing, the acoustic power is maximized for a given p and u.

A travelling-wave thermoacoustic refrigerator is characterized by the acoustic power having approximately travelling-wave phasing in the region of the regenerator. (In practice, it is impossible to have exactly travelling-wave phasing in the entire regenerator section.) With this phasing, the regenerator can be designed to approach optimal effectiveness, such that, ideally, the acoustic coefficient of performance (COP) of the refrigerator, which is given by $$COP_{aco} = \frac{\dot{Q}_C}{\dot{E}_1 - \dot{E}_2},$$

can approach the thermodynamic optimum known as the Carnot limit $$COP_{Car} = \frac{T_C}{T_H - T_C}.$$

. In the above formula, $\dot{Q}_c$ is the heat flux per unit time through the cold heat exchanger (i.e., the cooling power), $\dot{E}_1$ is the acoustic power incident on the regenerator, and $\dot{E}_2$ is the acoustic power leaving the regenerator. $\dot{E}_2$ has not been utilized for moving heat and remains available to do work.

For the phasing of the acoustic power in the region of the regenerator to be approximately travelling-wave, the acoustic load in a pulse-tube refrigerator must be dissipative. In other words, the power leaving the regenerator, $\dot{E}_2$, is discarded. The COP is therefore limited to $$COP_{PTR} = \frac{\dot{Q}_C}{\dot{E}_1}.$$

As $$\dot{E}_2 \approx \left(\frac{T_C}{T_H}\right)\dot{E}_1,$$

if $T_C \ll T_H$, as is the case for cryogenic cooling applications, $\dot{E}_1-\dot{E}_2 \approx \dot{E}_1$ and the reduction in COP is small. However, for smaller temperature changes, as are common for example in air conditioning and conventional refrigeration applications, $\dot{E}_2$ is relatively greater. In fact, as $T_C \rightarrow T_H$, $\dot{E}_2 \rightarrow \dot{E}_1$. Therefore, discarding $\dot{E}_2$ greatly reduces the maximum efficiency.

One method of loss recovery has been proposed in the aforementioned U.S. patent application Ser. Nos. 12/533,839 and U.S. patent application Ser. No. 12/533,874. According to these disclosures, the "excess" acoustic power is converted to electrical power by a transducer. The electrical power produced by the transducer is combined with the base electrical power driving the acoustic source. However, the conversion process itself has inherent losses that reduce the overall efficiency of the loss recovery scheme.

Another method that has been proposed, for example by Swift et al., J. Acoust. Soc. Am. 105 (2), Pt 1, February 1999, pp 711-724 (which is incorporated herein by reference), to recover the lost power, $\dot{E}_2$, is by removing the acoustic load and coupling the end of the refrigerator to the back face of the source. An example of a device 30 according to this proposal is shown in FIG. 2. Device 30 includes an acoustic source 32 housed in a body 34. Also housed in body 34 are first heat exchanger 36, regenerator 38, and second heat exchanger 40. Optionally, device 30 may include a pulse tube 42 and/or a third heat exchanger 44 (in each of the embodiments described herein, the pulse-tube is optional as well as the third heat exchanger). Acoustic power exiting either second heat exchanger 40, or third heat exchanger 44 if present, is coupled to the backside of acoustic source 32 by way of an acoustic transmission line 46 (which in one embodiment is a channel through which an acoustic wave may travel). In this configuration, $\dot{E}_3=\alpha\dot{E}_2$ is the portion of power $\dot{E}_2$ that is delivered to the back face of the source 32. The coefficient $\alpha$ represents losses in transmission line 46. The total power that must be generated by source 32 is thus $\dot{E}_1-\dot{E}_3=\dot{E}_1-\alpha\dot{E}_2$ and the maximum COP is $$COP_1 = \frac{\dot{Q}_C}{\dot{E}_1 - \alpha\dot{E}_2}.$$

In devices of this type, transmission line 46 is necessarily long and lossy, so $\alpha$ is small and power recovery is not very effective.

In a looped thermoacoustic refrigerator of the type shown in FIG. 2, consider $\theta_P=\arg(P_1(t))-\arg(P_3(t))$, the phase change of the oscillating pressure across the electromechanical transducer, or acoustic power generator. For positive power flow (arrows shown in FIG. 2), the phase angles between $P_1(t)$ and $U_1(t)$ and between $P_3(t)$ and $U_1(t)$ must both be less than 90°. Therefore $0°\leq\theta_P\leq180°$. The pressure phase change through the transmission line will approximate $\theta_T=\theta_L-\theta_P-\theta_R$, where $\theta_L$ represents the pressure phase change around the full loop and $\theta_R$ represents the pressure phase change in the regenerator and other functional parts of the refrigerator. For continuity, the pressure phase change around the full loop, $\theta_L$, must be a multiple of 360°. As no benefit is derived from using a greater multiple, we can assume $\theta_L=360°$. In an acoustic transmission line, the pressure and velocity phases both increase in the direction of power flow, giving $\theta_T>0°$. Furthermore, in an effective travelling wave regenerator, the pressure phase change is always positive, and in practice, $0°<\theta_R<90°$. The non-negativity of $\theta_R$ and $\theta_P$ implies $0°<\theta_T<\theta_T$. Consequently, $\theta_T=360°-\theta_P-\theta_R$, and usually the transmission line phase change $\theta_T>180°$. Such a large phase change requires a long, necessarily lossy, transmission line. The angle $\theta_T$ can in general be reduced by increasing $\theta_P$, but this is at the cost of available power. Likewise, increasing $\theta_R$ will increase losses.

Where "excess" acoustic power (not consumed in the cooling cycle) moving away from the acoustic source is looped back through an acoustic transmission line to the backside of the acoustic source, losses in the transmission line can substantially diminish or even outweigh the gains from the power recovery. In yet another method of power recovery, the "excess" acoustic power is routed to the front face of the acoustic source. This method may suffer from losses due to mass streaming effects. Thus, methods of recovering the acoustic power and reducing loss have not sufficiently optimized power recovery.

In a thermoacoustic refrigerator, optimal efficiency is achieved if the electrical power that must be delivered to the acoustic source or sources is minimized for a given cooling power. On the other hand, the cooling power is maximized in part by maximizing the acoustic power incident on the part of the device containing the heat exchangers and regenerator with the phasing of said acoustic power being approximately traveling-wave in that part of the device. Some of the acoustic power is necessarily not used to move heat. For high efficiency, a large part of this "excess" acoustic power must be utilized to reduce the electrical power required by the acoustic source. Heretofore, it has not been possible to utilize a significant portion of this excess acoustic power.

SUMMARY

Accordingly, the present disclosure is directed to improving efficiency of the thermoacoustic process, such as improving the efficiency of a thermoacoustic refrigerator or heat engine. The efficiency is achieved by providing multiple thermoacoustic stages connected in series such that excess acoustic power from a first stage is recovered and provided for driving a second stage.

By coupling multiple thermoacoustic refrigerator stages such that any "excess" acoustic power from a first stage is coupled to the back of the source of the next stage and so on until the "excess" acoustic power from the last stage is coupled to the back of the first stage, the correct phasings can be approximated with low losses for overall high efficiency. In one example, the apparatus consists of 2 stages, although the present disclosure should be understood to encompass a loop of three or more such connected refrigerator stages.

In addition, the heat exchangers of the various stages can be independently connected to heat exchange fluids and to thermal loads that are to be cooled by the refrigerator, in other embodiments various interconnections between the heat exchangers may be employed.

While refrigeration, such as for room air conditioning, preservation of perishable goods, scientific device applications and so forth, is one example described herein, the same process may produce heat energy, such as for room heating, material processing, and so forth. In this case the device is known as a heat pump.

With a slightly different configuration of its elements, the device can operated conceptually in reverse, as a heat engine. In this case heat energy is converted to mechanical or electrical work.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that descriptions of well known starting materials, processing techniques, components, equipment and other well known details are merely summarized or are omitted so as not to unnecessarily obscure the details of the present invention. Thus, where details are otherwise well known, we leave it to the application of the present invention to suggest or dictate choices relating to those details.

The various embodiments disclosed and discussed herein mitigate the losses associated with utilizing a transmission line for acoustic power recovery in a thermoacoustic device by reducing the overall transmission line length for a given acoustic power. In the embodiments disclosed we focus on a refrigerator, although it will be appreciated that the discussions herein apply equally to heat pumps, heat engines and other forms of thermoacoustic devices. The reduction in transmission line length, and control providing the desired pressure phase is accomplished by connecting two devices, for example two thermoacoustic refrigerators, in a looped series configuration, with the output of one device connected to the input of the other. Indeed, more than two devices may be so connected.

Figure 3:
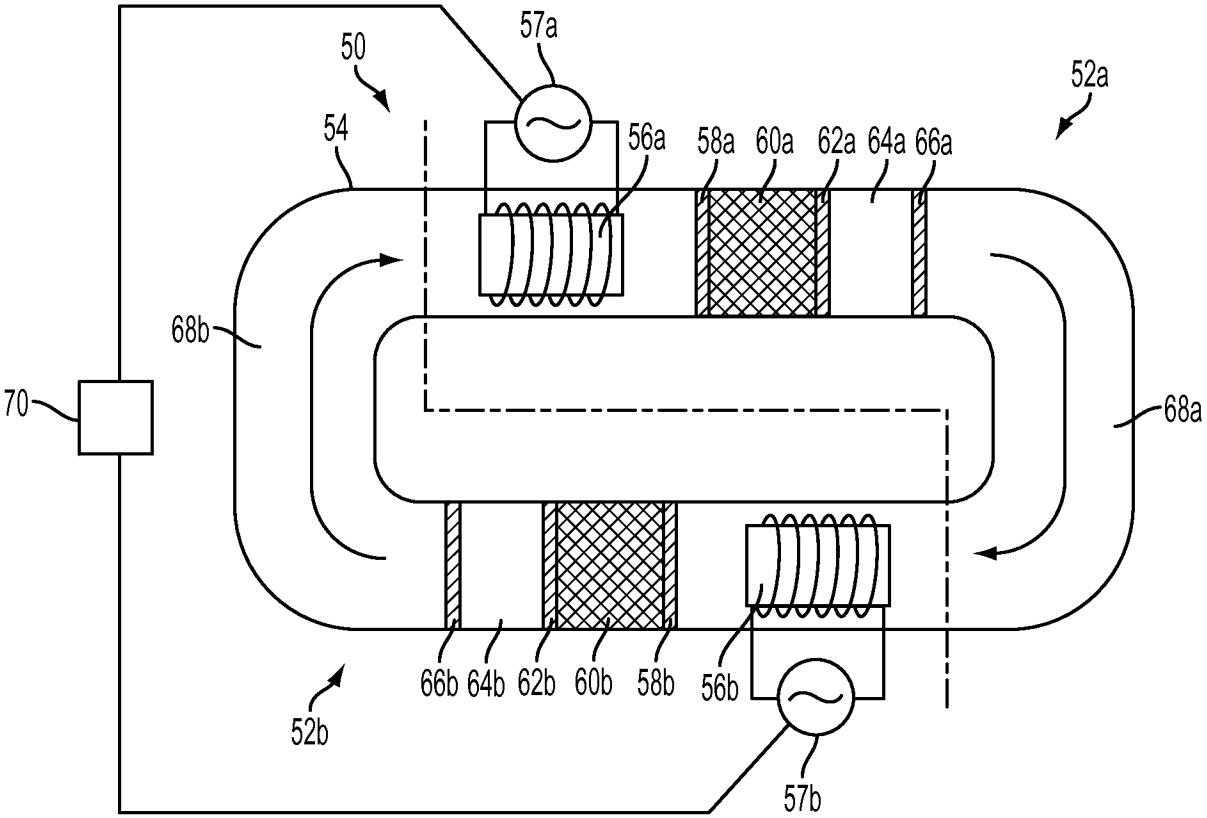
FIG. 3 is a schematic illustration of a closed-loop thermoacoustic apparatus with two series-connected stages according to an embodiment of the present disclosure.

With reference next to FIG. 3, there is shown therein a thermoacoustic apparatus 50 with series-connected stages according to the present disclosure. Device 50 consists of a number of individual thermoacoustic devices 52*a*, 52*b*, connected in a looped series arrangement within a housing 54. While two such devices 52*a*, 52*b* are shown and described in FIG. 3, the number of such devices forming the complete apparatus is not limited to two, as discussed further below. Housing 52 defines essentially a closed loop in which a pressurized gas may be disposed. Housing 52 may take one of a variety of shapes, and the actual shape is not a limitation on the scope of the present disclosure or claims appended hereto. Housing 52 may be formed of one of a variety of materials, but in general of a material which is generally thermally and acoustically insulative, and capable of withstanding pressurization to at least several atmospheres. Exemplary materials for housing 52 include stainless steel and iron-nickel-chromium alloys.

Disposed within housing 54 are elements of first thermoacoustic device 52*a* comprising an acoustic source 56*a*, first heat exchanger 58*a*, regenerator 60*a*, second heat exchanger 62*a*, optionally pulse tube 64*a*, and optionally third heat exchanger 66*a*. Also disposed within housing 54 are elements of second thermoacoustic device 52*b* comprising an acoustic source 56*b*, first heat exchanger 58*b*, regenerator 60*b*, second heat exchanger 62*b*, optionally pulse tube 64*b*, and optionally third heat exchanger 66*b*. Acoustic power exiting second heat exchanger 62*a*, or third heat exchanger 66*a* if present, of first thermoacoustic device 52*a* is coupled to the backside of acoustic source 56*b* of second thermoacoustic device 52*b* by way of a first transmission line 68*a*, and acoustic power exiting second heat exchanger 62*b*, or third heat exchanger 66*b* if present, of second thermoacoustic device 52*b* is coupled to the backside of acoustic source 56*a* of first thermoacoustic device 52*a* by way of a second transmission line 68*b*. The principles for calculating the correct dimensions for the transmission line are well-known to those skilled in the art.

Regenerators 60*a*, 60*b* may be constructed of any of a wide variety of materials and structural arrangements which provide a relatively high thermal mass and high surface area of interaction with the gas within housing 52, but which exhibit a relatively low acoustic attenuation. A wire mesh or screen, open-cell material, random fiber mesh or screen, or other material and arrangement as will be understood by one skilled in the art may be employed. The density of the material comprising regenerators 60*a*, 60*b* may be constant, or may vary along its longitudinal axis such that the area of interaction between the gas and wall, and the acoustic impedance, across the longitudinal dimension of the regenerators 60*a*, 60*b* may be tailored for optimal efficiency. Details of regenerator design are otherwise known in the art and are therefore not further discussed herein.

First heat exchangers 58*a*, 58*b*, second heat exchangers 62*a*, 62*b*, and optional third heat exchangers 66*a*, 66*b* may be constructed of any of a wide variety of materials and structural arrangements which provide a relatively high efficiency of heat transfer from within housing 54 to a transfer medium. In one embodiment some or all of the heat exchangers may be one or more tubes (not shown) for carrying a fluid therein to be heated or cooled. The tubes are formed of a material and sized and positioned to efficiently transfer thermal energy (heating or cooling) between the fluid therein and the gas within housing 54 during operation of the device. To enhance heat transfer, the surface area of the tubes may be increased with fins or other structures as is well known in the art. Details of heat exchanger design are otherwise known in the art, and are therefore not further discussed herein.

Acoustic sources 56*a*, 56*b* may be one of a wide variety of different types of devices. Examples include well-known electromagnetic linear alternator and piston, moving coil, piezo-electric, electro-static, ribbon or other form of loudspeaker capable of sufficient movement of the gas within housing 54. A very efficient, frequency-tunable, and frequency stable acoustic source design is preferred so that the energy output from the source may be maximized.

In the simplest embodiment, the two individual thermoacoustic devices 52*a*, 52*b* are identical. However, it is recognized that manufacturing variations and other non-idealities may inevitably result in differences in the two devices. Furthermore, if the design is such that temperatures at the heat exchangers in the two sections are not the same, any or all of the components of the two sections may differ for optimal performance.

With the basic physical elements and their interconnections described above, we now turn to the operation of apparatus 50. Initially, a gas, such as helium, is sealed within housing 54. Oscillating electric power is provided to the acoustic sources 57*a* and 57*b* which then generate acoustic oscillations in the gas. With proper choice of the dimensions and material choices for housing 54 and regenerators 58*a*, 58*b*, 62*a*, 62*b*, and use of an appropriate gas, an approximate Stirling cycle is thus initiated in the region of regenerators 60*a*, establishing temperature gradients in regenerators 60*a* and 60*b* such that when the system reaches steady-state, first heat exchangers 58*b*, 58*b*, the "hot" heat exchangers, are at relatively higher temperatures than second heat exchangers 62*a*, 62*b*, the "cold" heat exchangers. The Stirling cycle, illustrated in FIG. 4, comprises a constant-volume cooling of the gas as it moves in the direction from the hot heat exchanger to the cold heat exchanger at stage 1, rejecting heat to the regenerator, isothermal expansion of the gas at stage 2, constant-volume heating of the gas as it moves in the direction from the cold heat exchanger to the hot heat exchanger at stage 3, accepting heat from the regenerator, and consequent isothermal contraction of the gas at stage 4, at which point the gas cools again and the process repeats itself. In this way heat is moved from the cold to the hot heat exchangers. Regenerators 60*a*, 60*b* serve to store heat energy and greatly improve the efficiency of energy conversion.

Figure 4:
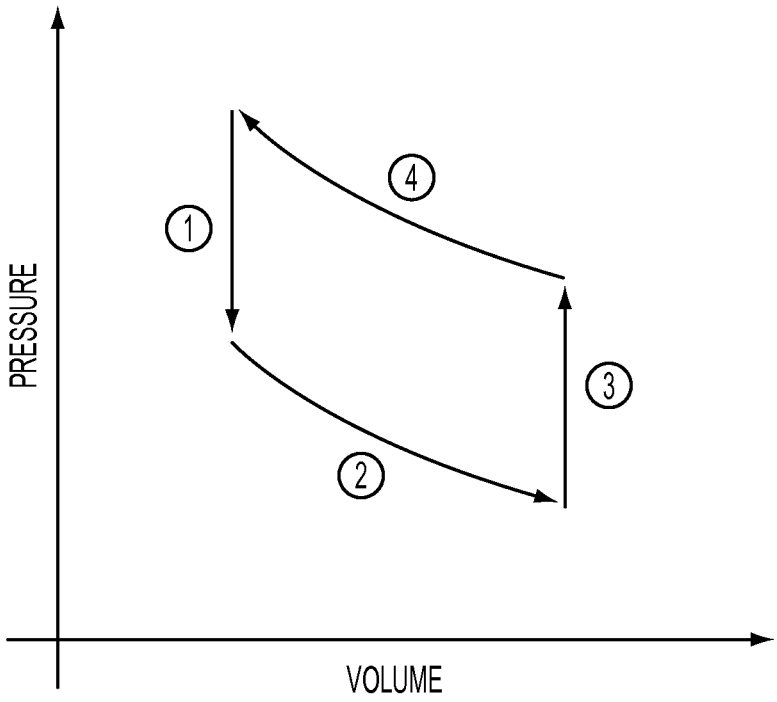
FIG. 4 is a chart of pressure versus volume at a regenerator within a stage of a refrigeration implementation of a closed-loop thermoacoustic apparatus with series-connected stages according to an embodiment of the present disclosure.

There will, however, be "excess" acoustic power generated by acoustic drives 56*a*, 56*b* that is not consumed in the Stirling cycle illustrated in FIG. 4. We next describe the recapture of that power. We begin by focusing on one of the thermoacoustic devices, 52*a*, and the effect of the connection between it and the other of the two thermoacoustic devices, 52*b*, in this example. Acoustic source 56*a* produces an acoustic wave that results in the Stirling cycle described above in the region of regenerator 60*a*. The acoustic wave generated by acoustic source 56*a* travels from acoustic source 56*a* in a direction towards regenerator 60*a*. A portion of that wave continues through the other elements of first thermoacoustic device 52*a* and ultimately into transmission line 68*a*. This "excess" acoustic power is directed by transmission line 68*a* to the backside of acoustic source 56*b*. The dimensions of the transmission line 68*a* are such that the excess acoustic power constructively adds to the electromechanical driving of acoustic source 56*b*, increasing the power output by acoustic source 56*b* for a fixed electrical power driving acoustic source 56*b*. Similarly, excess acoustic power produced by second thermoacoustic device 52*b* is directed by transmission line 68*b* to the backside of acoustic source 56*a* to thereby constructively add to the power produced by the acoustic source 56*a* for a fixed electrical power driving acoustic source 56*a*.

Figure 5A:
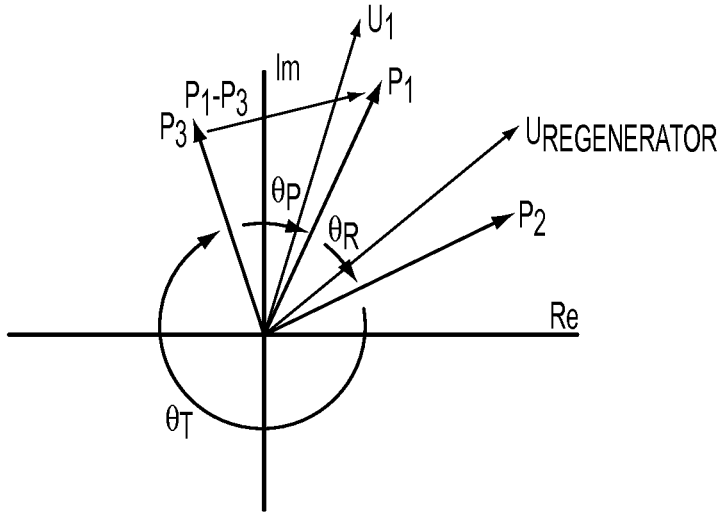
FIG. 5A PRIOR ART
FIGS. 5A and 5B are example of pressure and volume velocity phasors for a single-looped thermoacoustic refrigerator known in the art, and a closed-loop thermoacoustic apparatus with two series-connected stages according to an embodiment of the present disclosure, respectively.
Figure 5B:
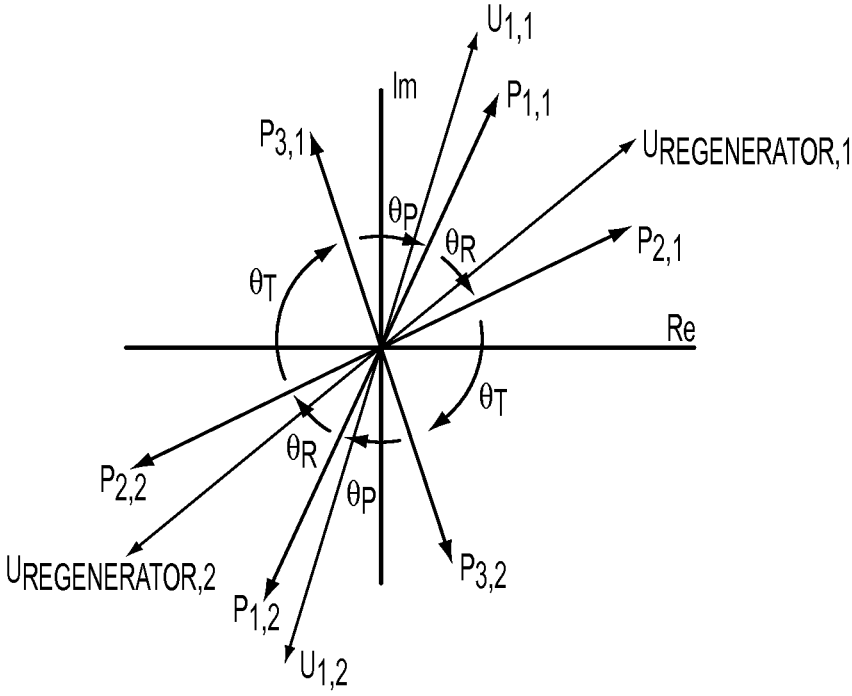

FIGS. 5A and 5B are examples of pressure and volume velocity phasors for a single-looped thermoacoustic refrigerator known in the art (FIG. 5A), and a closed-loop thermoacoustic apparatus with two series-connected stages according to the present disclosure (FIG. 5B). Note that while the core refrigerator phasors are identical in both systems, with the second set of phasors in the double-looped refrigerator rotated by 180°, the transmission line phase change, $\theta_T$, is reduced in the two-stage case of FIG. 5B. Also note that FIG. 5B is meant to convey the relationships among the several phasors, not their values which may vary according to the implementation.

Figure 1:
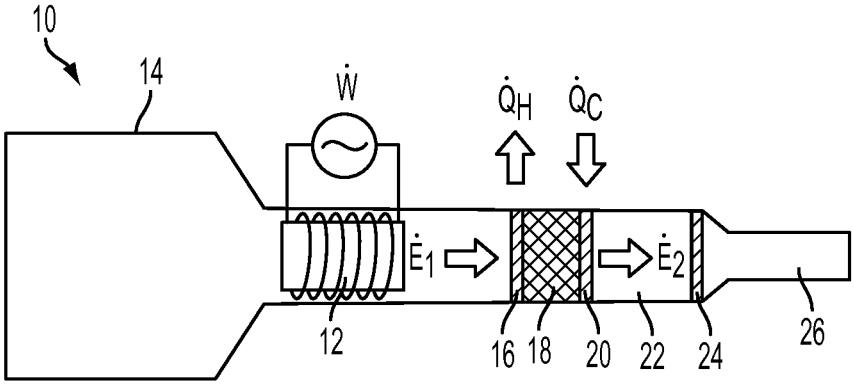
FIG. 1 PRIOR ART
FIG. 1 is an illustration of a pulse tube traveling-wave thermoacoustic refrigerator of a first type known in the art.
Figure 2:
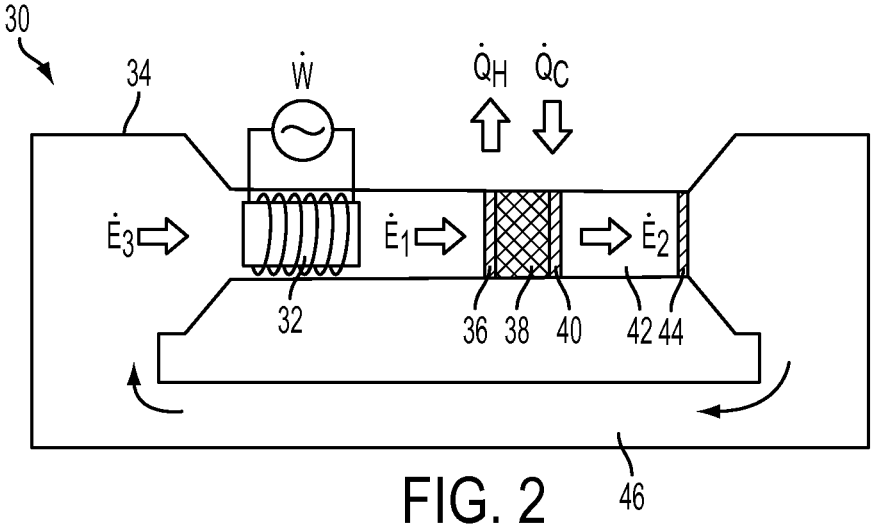
FIG. 2 PRIOR ART
FIG. 2 is an illustration of a traveling-wave thermoacoustic refrigerator of a second type known in the art.

Returning to FIG. 3, each acoustic source 56*a*, 56*b* is driven by a driving signal provided by a driver 57*a*, 57*b*, respectively. In one embodiment, driver 57*b* is operated 180° out of phase with the driver 57*a*. In this way, the phase shift needed by each transmission line 68*a*, 68*b* is reduced by 180° as compared with a device of the type in FIG. 2. This can reduce the transmission line losses significantly, and increase the COP of the refrigerator commensurately. Even a relatively small improvement in $\alpha$ from 0.9 to 0.95 can improve the efficiency of the refrigerator by 64%.

In general, the temperatures in coolers and heat engines are rarely fixed. Rather, they are functions of ambient conditions, heat availability, and user settings. When operated at a given power and frequency, the efficiencies of thermoacoustic refrigerators (and heat engines) vary with the temperatures of the hot, cold, and ambient heat exchangers. This effect is particularly significant in the case of a looped apparatus such as shown in FIG. 3 because such a system is resonant, with the resonant frequency depending in part on the length of the closed loop as well as the several heat exchanger temperatures, which affect the acoustic gain inside the regenerator, and, in the case of the engine, the load. As the temperatures change, the resonant frequency changes and the optimal frequency of operation also changes. By varying the frequency and/or input power of a thermoacoustic refrigerator as a function of these temperatures and the frequency and/or impedance of the electrical load of a thermoacoustic heat engine as a function of these temperatures, the efficiency can be improved. A system for varying the frequency and/or input power as a function of these temperatures and the frequency and/or impedance of the electrical load for the purpose of tuning the closed loop system for improved efficiency is disclosed in U.S. patent application Ser. No. 12/771,666, which is incorporated by reference herein. It will be noted that in certain embodiments is may be desirable to operate drivers 57*a* and 57*b* via a control 70 for setting the phase offsets for driving signals.

It will also be noted that the length and possibly other attributes which control the phase of the acoustic waves in the various transmission lines may be adjustable in use. In such an embodiment, which is not shown herein, the acoustic wave can be optimized by physical adjustment of the transmission line(s). Such adjustment may be empirically based, determined by an iterative process of trial-and-error, in order to accommodate for variations in the physical properties of the components of the system, which a theoretical model can only approximate. An arrangement for such adjustment will depend on the precise embodiment of the system disclosed herein, as will be recognized by one skilled in the art.

Figure 6:
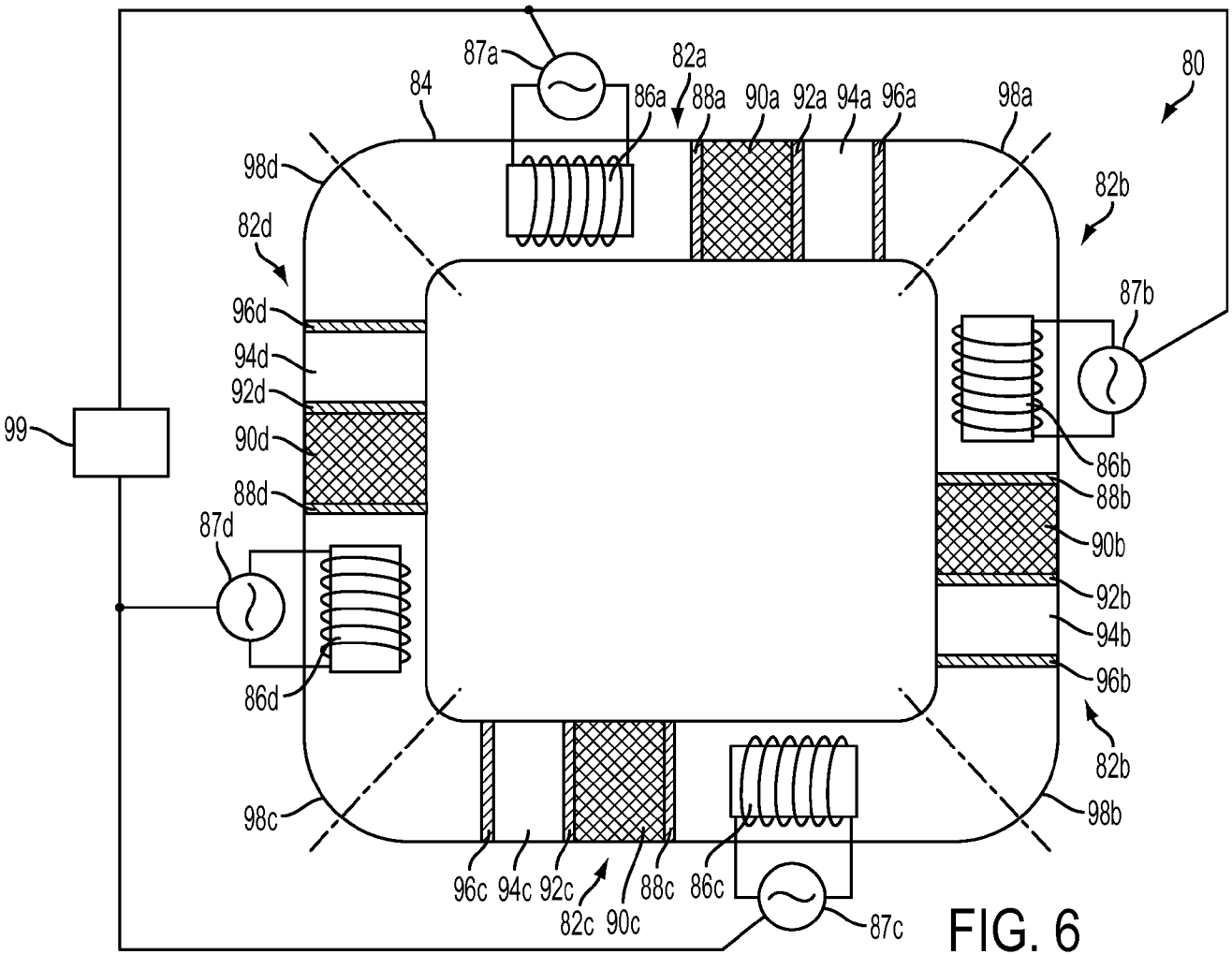
FIG. 6 is a schematic illustration of a closed-loop thermoacoustic apparatus with four series-connected stages according to an embodiment of the present disclosure.

While a closed loop with two stages has been shown and described above, in other embodiments, three, four, or more stages may be combined in series, with the phases of their driving signals spaced through 360°. FIG. 6 shows an example of an apparatus 80 which comprises four series-connected thermoacoustic device stages 82*a*, 82*b*, 82*c*, and 82*d* carried by a housing 84. Disposed within housing 84 are elements of first thermoacoustic device 82*a* comprising acoustic source 86*a*, first heat exchanger 88*a*, regenerator 90*a*, second heat exchanger 92*a*, optional pulse tube 94*a*, and optional third heat exchanger 96*a*. Also disposed within housing 84 are elements of second thermoacoustic device 82*b* comprising acoustic source 86*b*, first heat exchanger 88*b*, regenerator 90*b*, second heat exchanger 92*b*, optional pulse tube 94*b*, and optional third heat exchanger 96*b*. Still further, disposed within housing 84 are elements of third thermoacoustic device 82*c* comprising acoustic source 86*c*, first heat exchanger 88*c*, regenerator 90*c*, second heat exchanger 92*c*, optional pulse tube 94*c*, and third optional heat exchanger 96*c*. Finally, disposed within housing 84 are elements of fourth thermoacoustic device 82*d* comprising acoustic source 86*d*, first heat exchanger 88*d*, regenerator 90*d*, second heat exchanger 92*d*, optional pulse tube 94*d*, and optional third heat exchanger 96*d*.

Acoustic power exiting second heat exchanger 90*a*, or third heat exchanger 96*a* if present, of first thermoacoustic device

82*a* is coupled to the backside of acoustic source 86*b* of second thermoacoustic device 82*b* by way of first transmission line 98*a*. Acoustic power exiting second heat exchanger 90*b*, or third heat exchanger 96*b* if present, of second thermoacoustic device 82*b* is coupled to the backside of acoustic source 86*c* of third thermoacoustic device 82*c* by way of second transmission line 98*b*. Acoustic power exiting second heat exchanger 90*c*, or third heat exchanger 96*c* if present, of third thermoacoustic device 82*c* is coupled to the backside of acoustic source 86*d* of fourth thermoacoustic device 82*d* by way of third transmission line 98*c*. Finally, to complete the loop, acoustic power exiting second heat exchanger 90*d*, or third heat exchanger 96*d* if present, of fourth thermoacoustic device 82*d* is coupled to the backside of acoustic source 86*a* of first thermoacoustic device 82*a* by way of fourth transmission line 98*d*. Operation of apparatus 80 is substantially as described above, with the output of one stage providing its excess acoustic power to the backside of the acoustic source of the next adjacent stage, and the operating parameters selected so that that excess acoustic power reduces the electrical power input to the acoustic source of the next adjacent stage for a given output acoustic power of said source. For an acoustic source that is operated at its resonant frequency, this can be accomplished by obtaining an oscillating pressure at the backside of the acoustic source that is in phase with the oscillating pressure at the front of the source. Likewise, for a source that is operated out of resonance, there is an optimal non-zero phase difference between these two pressures that should be approximated as nearly as possible.

It will therefore be appreciated that the number of sections of a thermoacoustic apparatus with series-connected stages according to the present disclosure is not limited to 2 or 4 described above, but may be an appropriate number depending on and determined by the application, design constraints, and other implementation specific details presented. With n identical stages, the necessary pressure phase change through each transmission line is $$\theta_{T,n} = \frac{360^\circ}{n} - \theta_P - \theta_R.$$

As the pressure phase angle, $\theta_P$, can be reduced to zero by operating the transducer at its mechanically resonant frequency and with $\phi_{P_1} - \phi_U = 0$, the only theoretical limit to the number of sections is the intrinsic phase change, $\theta_R$. This is not fixed, but is a function of the design of the refrigerator section. In the limit as $\theta_R \rightarrow 0$, the number of sections theoretically approaches infinity, though in practice, as $\alpha$ nears one, the incremental gains of adding additional sections may be offset by the additional cost and complexity of the system. If the several stages are operated under different conditions, for example with different temperatures at the heat exchangers, the stages will not be identical. The sum of all phase angles through all the transmission lines, across all the transducers, and through all the refrigerator sections will be 360°.

Figure 7:
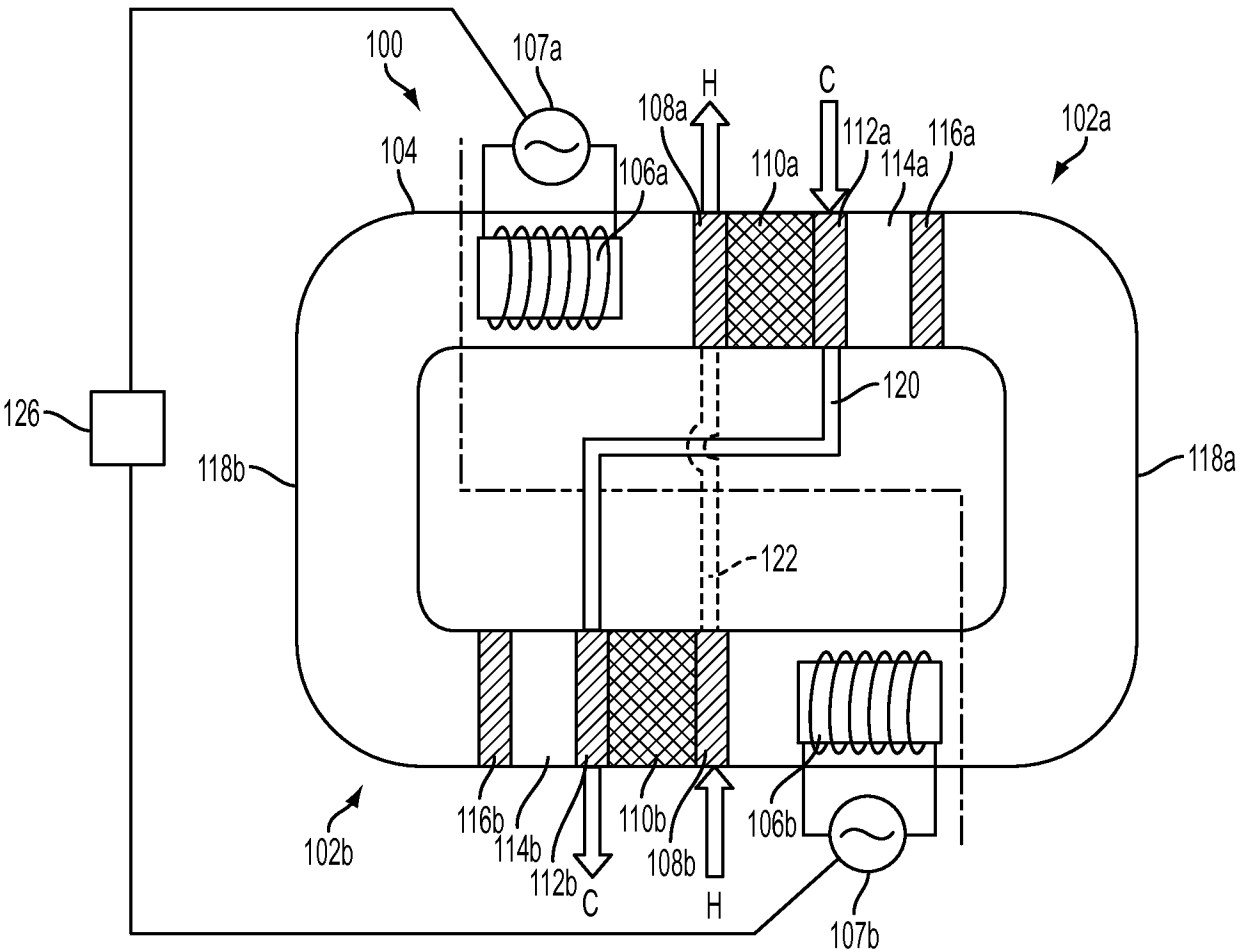
FIG. 7 is a schematic illustration of a closed-loop thermoacoustic apparatus with two series-connected stages and interconnected heat exchangers according to an embodiment of the present disclosure.

With reference next to FIG. 7, apparatus 100 is shown according to another embodiment of the present disclosure. While in certain applications it may be desirable to independently connect the various heat exchangers to heat exchange fluids and to a thermal load which is to be cooled by the refrigerator, in other embodiments various interconnections of the heat exchangers may be employed.

Apparatus 100, consists again of two individual thermoacoustic devices 102*a*, 102*b*, connected in a looped series arrangement within a housing 104. Disposed within housing 104 are elements of first thermoacoustic device 102*a* comprising an acoustic source 106*a*, first heat exchanger 108*a*, regenerator 110*a*, second heat exchanger 112*a*, pulse tube 114*a*, and optional third heat exchanger 116*a*. Also disposed within housing 104 are elements of second thermoacoustic device 102*b* comprising an acoustic source 106*b*, first heat exchanger 108*b*, regenerator 110*b*, second heat exchanger 112*b*, pulse tube 114*b*, and optional third heat exchanger 116*b*. Acoustic power exiting either second heat exchanger 112*a*, or third heat exchanger 116*a* if present, of first thermoacoustic device 102*a* is coupled to the backside of acoustic source 106*b* of second thermoacoustic device 102*b* by way of first transmission line 118*a*, and acoustic power exiting second heat exchanger 112*b*, or third heat exchanger 116*b* if present, of second thermoacoustic device 102*b* is coupled to the backside of acoustic source 106*a* of first thermoacoustic device 102*a* by way of second transmission line 118*b*. The composition of characteristics of the various elements comprising apparatus 100 may be substantially as described above, and the number of individual stages comprising apparatus 100 may be greater than two.

Each thermoacoustic device 102*a*, 102*b* includes at least first heat exchangers 108*a*, 108*b*, respectively, which comprise the "hot" heat exchangers, and second heat exchangers 112*a*, 112*b*, respectively, which comprise the "cold" heat exchangers. In the embodiment shown in FIG. 7, fluid channel 120 connects the "hot" heat exchangers 108*a*, 108*b*. Similarly, fluid channel 122 connects the "cold" heat exchangers 112*a*, 112*b*. As between fluids flowing from an external supply (not shown) in through heat exchangers 112*a* and 108*b*, through channels 120, 122, and out through heat exchangers 112*b* and 108*a* to a receiver (not shown) external to apparatus 100, fluid flowing through exchangers 108*a*, 108*b* will be at a higher temperature than fluid flowing through exchangers 112*a*, 112*b*. For purposes of this discussion, we define $TH_a$ as the temperature of the surface of the "hot" heat exchanger 108*a*, $TH_b$ as the temperature of the surface of the "hot" heat exchanger 108*b*, $TC_a$ as the temperature of the surface of the "cold" heat exchanger 112*a*, and $TC_b$ as the temperature of the surface of the "cold" heat exchanger 112*b*.

The multistage thermoacoustic device 100 is operated such that $TC_b \leq TC_a$, and $TH_b \leq TH_a$. That is, the fluid flow is in the direction of arrows "H" and "C" shown in FIG. 7, effectively in reverse directions relative to one another. Efficiency of apparatus 100 is thereby improved, as compared for example to operating apparatus 100 such that the fluid flow directions are the same though the "hot" and "cold" heat exchangers (e.g., an improvement over fluid flow from 108*a* to 108*b* and 112*a* to 112*b*). A mode of operation in which $TC_b < TC_a$, and $TH_b < TH_a$ provides improved efficiency as compared to a mode of operation in which each of the heat exchangers operated with $TC_a = TC_b$ and $TH_a = TH_b$.

In another mode of operation, the hot heat exchangers are connected to two independent hot streams at the same temperature, so that TCb ≤TCa, but THb=THa. This configuration could, in some applications, improve efficiency, but requires that the two stages of the device be operated at different temperature differentials (i.e., THa−TCa≠THb−TCb). Selection of operating mode will depend on the particular design and application of the thermoacoustic device, as well as the operation of a control system, such as taught be the aforementioned U.S. patent application Ser. No. 12/771,666.

The apparatus of two stages described above may be generalized for an apparatus (not shown) comprising n stages. For such an n-stage thermoacoustic apparatus, with hot heat exchangers $HX_1 \ldots HX_n$ and cold heat exchangers $CX_1 \ldots$ $CX_n$, the hot outside fluid stream would contact $HX_n$, then $HX_{n-1}$, sequentially down to $HX_1$. The cold outside stream would contact $CX_R$, then $CX_2$, sequentially to $CX_n$.

For given values of the several heat exchanger temperatures, the optimal lengths of the transmission lines and the optimal design of the heat exchangers and regenerators of the different sections may differ, ether intentionally or otherwise (i.e., each stage need not be identical). In addition, the optimal relative phasing of the input electrical power to the different drivers of a device with n stages may not be 360°/n. Thus, one method of determining the optimal phasing is to operate the device with the desired heat exchanger temperatures and vary the electrical phase to one or both drivers until optimal performance is achieved.

Figure 8:
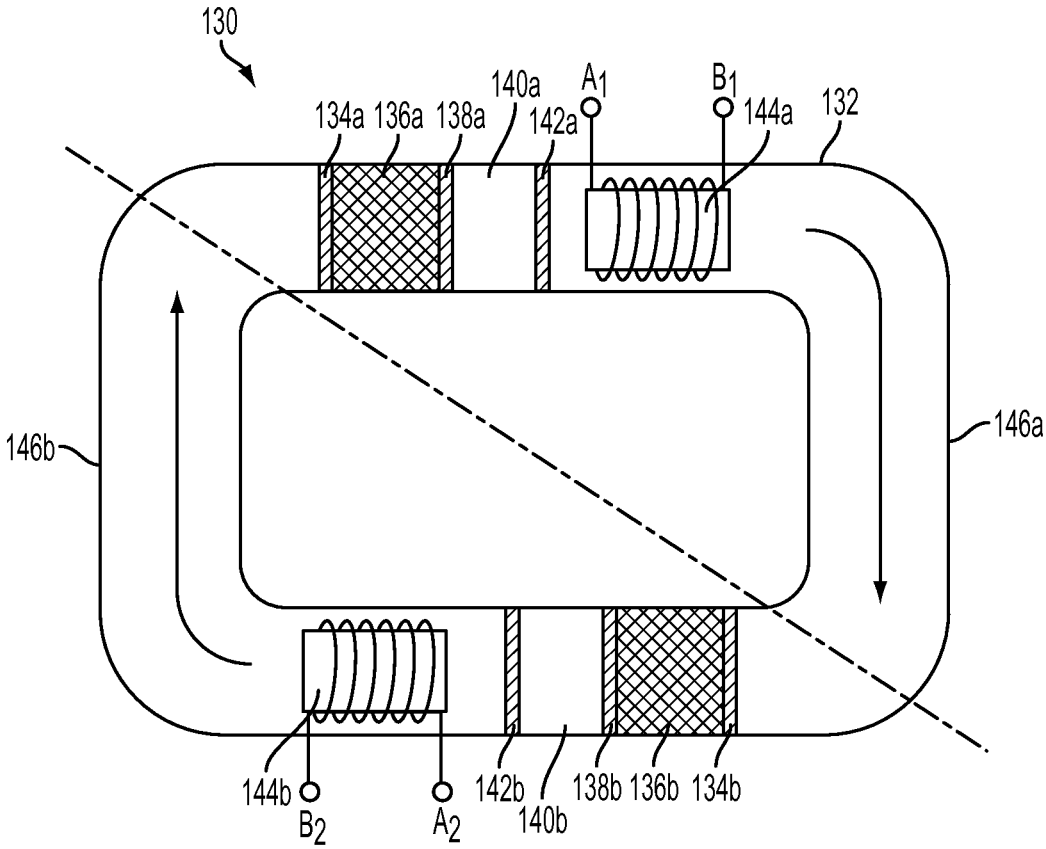
FIG. 8 is a schematic illustration of a closed-loop heat engine with two series-connected stages according to an embodiment of the present disclosure.

While the above description is in terms of an apparatus for refrigeration, many aspects thereof apply equally to heat engines, which are devices that convert heat energy to mechanical or electrical work. Broadly, when apparatus 50 is operated as a heat engine (e.g., heat is extracted from a load or working fluid through a heat exchanger), the relative positions of the elements within the core of the device may be switched. With reference to FIG. 8, which illustrates a two stage looped heat engine 130 according to one embodiment of the present disclosure, first heat exchangers 134*a*, 134*b* within housing 132 are operated as the "cold" heat exchangers, and second heat exchangers 138*a*, 138*b* are operated as the "hot" heat exchangers. First heat exchangers 134*a* and 138*a* are on either side of first regenerator 136*a*, and similarly first heat exchangers 134*b* and 138*b* are on either side of second regenerator 136*b*. Also disposed within housing 132 are first acoustic transducer 144*a*, optional pulse tube 140*a*, and optional third heat exchanger 142*a*, as well as second acoustic transducer 144*b*, optional pulse tube 140*b*, and optional third heat exchanger 142*b*.

During operation, acoustic oscillations are induced in the gas with approximately travelling-wave phasing in the region of the regenerators 136*a* and 136*b*. Acoustic power is coupled to the acoustic transducers 144*a* and 144*b* such that electrical power can be extracted from terminals $A_1$ and $B_1$ and $A_2$ and $B_2$ as described below. Excess acoustic power exiting first acoustic transducer 144*a* is coupled to first heat exchanger 134*b* by way of a first transmission line 146*a*, and likewise acoustic power exiting second acoustic source 144*b* is coupled to first heat exchanger 134*a* by way of second transmission line 146*b*.

Figure 9:
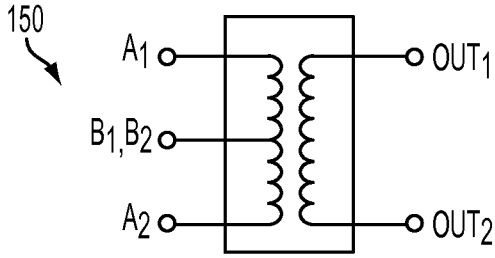
FIG. 9 is a schematic illustration of an exemplary load for a closed-loop heat engine with two series-connected stages, such as illustrated in FIG. 8.

It will be noted that each acoustic transducer 144*a*, 144*b* has two connection terminals $A_1$, $B_1$, and $A_2$, $B_2$, respectively. These terminals are connected to a load. An example of a load 150 and connections to connection terminals $A_1$, $B_1$, and $A_2$, $B_2$, is illustrated in FIG. 9, representing a simple load for a two-stage device with the two stages 180 degrees out of phase. It will be appreciated that many different load configurations are contemplated by the present disclosure, as will be understood by one skilled in the art.

Figure 10:
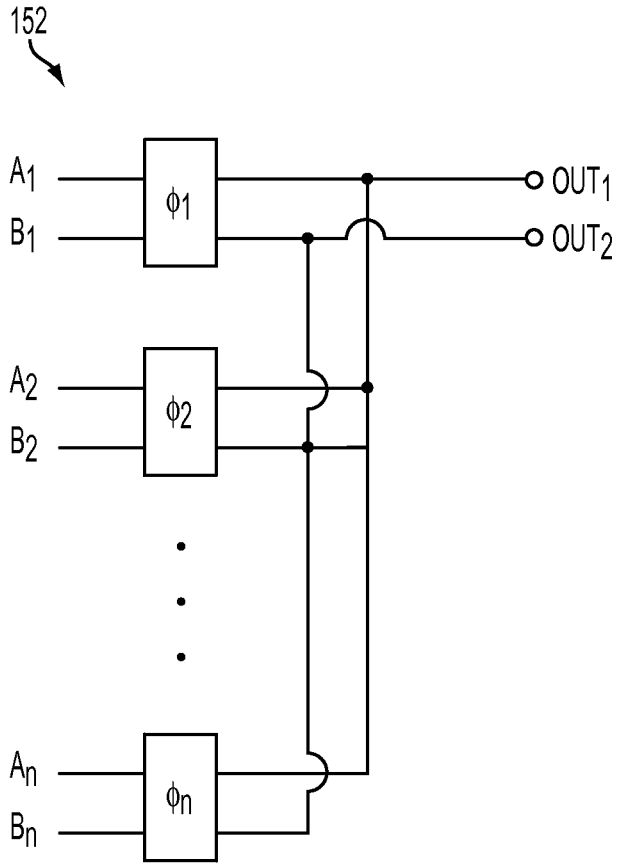
FIG. 10 is a schematic illustration of an exemplary output coupling circuit for an n-stage device heat engine with two series-connected stages according to an embodiment of the present disclosure.

While a two-stage heat engine has been illustrated and discussed with regard to FIGS. 8 and 9, the disclosure can be extended to a closed-loop heat engine of n-stages, much as discussed above with regard to a closed-loop refrigerator of n-stages. The combined load must be tuned to set the phases at each transducer. This would be done via input stages from each section of the device. An example of an output coupling circuit 152 for an n-stage device is illustrated in FIG. 10. Elements $\phi_1, \phi_2, \ldots \phi_n$ represent phase shifters which bring all output phases together.

The design and layout of a thermoacoustic apparatus with series-connected stages according to the disclosure above is sufficiently flexible that many different configurations, modes of operations, applications, and so forth may be accommodated. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein. While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternatives thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A thermoacoustic apparatus, comprising:

a plurality of stages, each stage comprising:

a closed, generally hollow body having a first end and a second end, for containing a working gas;

an apparatus core, comprising:

a regenerator disposed within said body;

a first heat exchanger disposed within said body and proximate said regenerator at a first longitudinal end thereof;

a second heat exchanger disposed within said body and proximate said regenerator at a second longitudinal end thereof;

an acoustic source disposed within said generally hollow body;

a drive signal source, communicatively coupled to said acoustic source, for providing a drive signal for said acoustic source; and an acoustic transmission line having a first end and a second end, said first end of said transmission line coupled to said second end of said body; and;

a control system communicatively coupled to each said drive signal source for providing said drive signals with a set phase offset relative to one another;

said plurality of stages communicatively coupled together in series to form a loop such that said second end of said transmission line of a first stage is communicatively coupled to said first end of said body of a second stage following said first stage in said series; and whereby, said communicative coupling of said stages and said control system permits excess acoustic power from said first stage to be transmitted within said transmission line of said first stage to said second stage at a selected phase of said acoustic source of said second stage.

2. The thermoacoustic apparatus of claim 1, wherein said acoustic source of each stage is operated, and said transmission line of each said stage is dimensioned, such that said excess acoustic power from said first stage is communicated to said second stage with a pressure phase at a back region of said acoustic source of said second stage such that electric power required by the acoustic source of said second stage is minimized for a given acoustic power produced by said second stage.

3. The thermoacoustic apparatus of claim 1, wherein said thermoacoustic apparatus is a refrigerator and further wherein said acoustic source is located proximate said first end of said body such that acoustic energy from said acoustic source is directed into said body in a direction toward said regenerator, first heat exchanger, and second heat exchanger.

4. The thermoacoustic apparatus of claim 1, wherein said apparatus comprises n stages, and further wherein a transmission line pressure phase change, $\theta_T$,n through each transmission line is substantially equal to $$\theta_{T,n} = \frac{360°}{n} - \theta_P - \theta_R,$$

Where $\theta_P$ represents the phase change of an oscillating pressure across the acoustic source and $\theta_R$ represents the pressure phase change in the apparatus core.

5. The thermoacoustic apparatus of claim 1, wherein said apparatus comprises n stages, and further wherein for each stage, i, where $0<i\leq n$, the sum of transmission line pressure phase changes, $$\sum_{i=1}^{n} \theta_{T,i}$$

through the transmission lines is substantially equal to $$\sum_{i=1}^{n} \theta_{T,j} = 360° - \sum_{i=1}^{n} (\theta_{P,i} - \theta_{R,i}),$$

where $\theta_{P,i}$ represents the phase change of an oscillating pressure across an ith acoustic source and $\theta_{R,i}$ represents the pressure phase change in an ith regenerator.

6. The thermoacoustic apparatus of claim 1, wherein n=2.

7. The thermoacoustic apparatus of claim 1, further comprising, for each stage, a electric source communicatively connected to said acoustic source of said stage for providing a driving signal to said acoustic source of said stage.

8. The thermoacoustic apparatus of claim 1, wherein said acoustic source is an audio speaker.

9. The thermoacoustic apparatus of claim 1, wherein said acoustic source is an electromagnetic linear alternator and piston.

10. The thermoacoustic apparatus of claim 1, each stage further comprising a pulse tube and third heat exchanger disposed within said body and between said second heat exchanger of said stage and said transmission line of said stage.

11. The thermoacoustic apparatus of claim 3, further comprising:

a first channel communicatively coupling said first heat exchanger of a first stage to said first heat exchanger of a second stage configured to permit a heat transfer medium to flow from said first heat exchanger of said first stage through said first channel to said first heat exchanger of said second stage.

12. The thermoacoustic apparatus of claim 11, further comprising:

a second channel communicatively coupling said second heat exchanger of a first stage to said second heat exchanger of a second stage, configured to permit a heat transfer medium to flow from said second heat exchanger of said first stage through said second channel to said second heat exchanger of said second stage.

13. A thermoacoustic apparatus, comprising:

a plurality of stages, each stage comprising:

a closed, generally hollow body having a first end and a second end, for containing a working gas;

a regenerator disposed within said body;

a first heat exchanger disposed within said body and proximate said regenerator at a first longitudinal end thereof;

a second heat exchanger disposed within said body and proximate said regenerator at a second longitudinal end thereof;

an acoustic source disposed within said generally hollow body proximate said first end of said body such that acoustic energy from said acoustic source is directed into said body in a direction toward said regenerator, first heat exchanger, and second heat exchanger;

a drive signal source, communicatively coupled to said acoustic source, for providing a drive signal for said acoustic source; and a transmission line having a first end and a second end, said first end of said transmission line coupled to said second end of said body;

a plurality of channels, each stage connected to another stage of said apparatus such that a first heat exchanger of a first stage is communicatively coupled by a first channel to a first heat exchanger of a second stage, said first channel configured to permit a heat transfer medium to flow from said first heat exchanger of said first stage through said first channel to said first heat exchanger of said second stage, and a second heat exchanger of said first stage is communicatively coupled by a second channel to a second heat exchanger of said second stage, said second channel configured to permit a heat transfer medium to flow from said second heat exchanger of said first stage through said second channel to said second heat exchanger of said second stage;

a control system communicatively coupled to each said drive signal source for providing said drive signals with a set phase offset relative to one another; and said plurality of stages further communicatively coupled together in series to form a closed loop such that said second end of said transmission line of a first stage is communicatively coupled to said first end of said body of a second stage following said first stage in said series, said stages communicatively coupled together and configured to permit excess acoustic power from said first stage to be transmitted within said transmission line of said first stage to said acoustic source of said second stage;

said acoustic source of each stage operated, and said transmission line of each said stage having dimensions, such that said excess acoustic power from said first stage is communicated to said second stage with a pressure phase at a back region of said acoustic source of said second stage such that electric power required by the acoustic source of said second stage is minimized for a given acoustic power produced by said second stage.

14. The thermoacoustic apparatus of claim 13, wherein said apparatus comprises n stages, and further wherein for each stage, i, where $0<i\leq n$, the sum of transmission line pressure phase changes, $$\sum_{i=1}^{n} \theta_{T,i}$$

through the transmission lines is substantially equal to $$\sum_{i=1}^{n} \theta_{T,i} = 360° - \sum_{i=1}^{n} (\theta_{P,i} - \theta_{R,i}),$$

where $\theta_{P,i}$ represents the phase change of an oscillating pressure across an ith acoustic source and $\theta_{R,i}$ represents the pressure phase change in an ith regenerator.

15. The thermoacoustic apparatus of claim 13, wherein n=2.

16. The thermoacoustic apparatus of claim 13, further comprising, for each stage, an electric driver communicatively connected to said acoustic source of said stage for providing a driving signal to said acoustic source of said stage.

17. The thermoacoustic apparatus of claim 13, wherein said acoustic source is selected from the group consisting of: an audio speaker and an electromagnetic linear alternator and piston.

18. The thermoacoustic apparatus of claim 13, each stage further comprising a pulse tube region and a third heat exchanger disposed within said body and between said second heat exchanger of said stage and said transmission line of said stage.

19. A method of operating a thermoacoustic apparatus of a type including a plurality of stages, each stage containing within a generally hollow body heat exchangers, an acoustic source and a transmission line, each acoustic source communicatively coupled to a drive signal source for driving said acoustic source, each stage coupled to a succeeding stage by a channel in order to form a looped apparatus, the method comprising:

directing excess acoustic power from a first of said plurality of stages into said transmission line of said first stage;

directing said excess acoustic power in said transmission line of said first stage to said acoustic source of a second of said plurality of stages; and controlling, by way of a control system, the phase of each said driving signal relative to all other driving signals, such that the phase of said acoustic source of said second of said plurality of stages is operated in phase with the receipt of said excess acoustic power of said first of said plurality of stages;

whereby said second stage utilizes said power in the production of its own acoustic power.

20. The method of claim 19, further comprising operating said acoustic source of said first stage such that said excess acoustic power from said first stage is communicated to said second stage with a pressure phase at a back region of said acoustic source of said second stage such that electric power required by the acoustic source of said second stage is minimized for a given acoustic power produced by said second stage.

* * * * *